United States Patent [19]

Rutherford et al.

[11] Patent Number: 4,629,366

[45] Date of Patent: Dec. 16, 1986

[54] OFFSHORE MARINE STRUCTURE WITH CORROSION PROTECTION

[75] Inventors: David A. Rutherford, New Orleans, La.; Brian D. Barr, Florence, Ala.; Douglas W. Rommelmann, Carlyle, Ill.

[73] Assignee: Texaco Inc., White Plains, N.Y.

[21] Appl. No.: 663,255

[22] Filed: Oct. 22, 1984

[51] Int. Cl.[4] ..... E02B 17/00; C23F 13/00

[52] U.S. Cl. ..... 405/211; 204/197; 405/195

[58] Field of Search ..... 405/211, 195, 216; 204/197, 196, 148

[56] References Cited

U.S. PATENT DOCUMENTS 4,056,446 11/1977 Vennett ..... 204/197 X
4,415,293 11/1983 Engel et al. ..... 405/211 X
4,484,839 11/1984 Nandlal et al. ..... 405/211
4,484,840 11/1984 Nandlal et al. ..... 405/211

*Primary Examiner*—Dennis L. Taylor
*Attorney, Agent, or Firm*—Robert A. Kulason; James J. O'Loughlin; Robert B. Burns

[57] ABSTRACT

A marine structure adapted to be at least partially submerged at an offshore body of water to drill wells into the ocean floor and to produce fluids therefrom. A corrosion deterrent system for protecting the submerged members of the structure comprises sacrificial anodes which are disposed about the structure's jacket.

A drilling template carried on the jacket comprises means to a plurality of drilling conductors therein. At least one upright column incorporated into said drilling template is provided with discretely placed sacrificial anodes arranged to best protect the drill conductors.

10 Claims, 6 Drawing Figures

OFFSHORE MARINE STRUCTURE WITH CORROSION PROTECTION

BACKGROUND OF THE INVENTION

Offshore marine structures such as production and well drilling platforms, presently utilize conductors for well drilling operations as well as for the subsequent production of fluids such as crude oil and gas.

In the instance of any metallic structure which is submerged in an offshore body of water, the problem of electrolytic corrosion of metallic parts will be prevalent. In such an electrolytic action, some submerged surfaces of the structure act as anodes whereas other parts function as cathodes. Over a period of time, the anode segments will tend to erode and deteriorate whereas the cathodic parts will not be similarly effected.

One way to minimize or to completely avoid electrolytic corrosion in off shore structures of this nature, is through the use of sacrificial anodes. These are normally formed of zinc, aluminum, aluminum alloys, magnesium, or a similar metal which is capable of providing the desired potential. Thus, over a period of time the sacrificial body which is chemically active with sea water, will be dissolved or eaten away and have to be replaced. The main body of the metallic structure will however be unaffected.

This form of cathodic protection is well known in the offshore industry. It has been utilized for protecting many submergible metallic bodies, including the presently discussed marine platform for drilling wells, and for producing hydrocarbon products.

Many existing marine platforms which embody a jacket section as the main support component, utilize aluminum alloy sacrificial anodes which are strategically located about the submerged part of the jacket structure. These anodes will be gradually eroded away as noted above. They will, however, serve as a means of cathodic protection for the platform.

Recent trends in deep water drilling and production platforms of the type contemplated, have resulted in more massive marine structures. This leads in turn to large numbers of drilling conductors, or more dense conductor arrays to optimize fluid production. As a result, the conductors, which are normally fabricated of steel, and thus subject to corrosion, are grouped together within the jacket at a considerable distance from anode carrying structure members.

Normally, such a jacket particularly adapted to deep water use, is comprised of an open framework of steel members which carry judicially spaced sacrificial anodes. Two phenomena thereby occur which are considered detrimental to adequate cathodic protection of the drilling conductors. These include firstly, the jacket horizontal framing levels are spaced so far apart that sacrificial anodes placed at these levels have inadequate current (throw) to protect steel members located between the levels and beyond the anodes range.

Secondly, due to the physical congestion prompted by the large number of drilling conductors within a relatively small area, interior conductors in the array are shielded from the protective effects of the sacrificial anodes positioned on external or peripheral conductors. Thus, no appreciable electrolytic ion exchange occurs between the sacrificial anodes and the shielded or internal conductors in the array. This circumstance results in relatively poor or no cathodic protection whatsoever for the latter.

The offshore drilling industry has appreciated and approached the problem of drilling conductor corrosion. Further, it has succeeded to a degree in countering the problem. The attempted solutions have been addressed principally to elimination, or at least reduction of the aforementioned detrimental effects. These approaches extend across a wide range including conservative cathodic protection systems which rely on the use of many more anodes than are necessary. This method, however, is found to be expensive even though preinstalled, and can be ineffective as well.

An alternative method of applying the desired protection is through use of expensive in-situ installation of the sacrificial anodes on or around conductors after the platform has been immersed at its offshore site. Both these methods tend toward excessive costs, are often remedial in nature and frequently unsatisfactory in performance.

SUMMARY OF THE INVENTION

The invention hereinafter disclosed is addressed to a marine structure for drilling wells into the floor of an offshore body of water, which structure includes the expedient of sacrificial anodes for the avoidance of cathodic corrosion. The structure utilizes a steel jacket which rests on the ocean floor and supports a working deck. The jacket is provided with a plurality of primary sacrificial anodes which are carried at varied levels of the jacket to best afford the desired cathodic protection at all water depths.

A drilling template incorporated into the jacket includes a plurality, or array of closely arranged conductors which are aligned in a generally upright position to guide a downwardly moving drill string.

To avoid corrosion of the steel conductors, the template is provided with anodes which are disposed about the periphery thereof. At least one upstanding column or conductor is positioned at the interior of the conductor array. Sacrificial anodes depending from said column, function to supplement the function of the primary sacrificial anodes.

It is therefore an object of the invention to provide an offshore marine structure for drilling wells and the like which structure is capable of avoiding or minimizing corrosive damage to submerged structural parts.

A further objective is to utilize an offshore structure in which a drilling template is included, such that drilling conductors carried by said template are afforded a higher degree of corrosive protection than would normally be found on such structures.

DESCRIPTION OF THE DRAWINGS

Referring to FIG. 1, a marine structure 10 of the type presently contemplated is shown embedded into the ocean floor 11 of an offshore body of water. The structure comprises primarily a jacket formed of a plurality of support legs 12 and 13 which extend from the ocean floor 11, to a point above water level. The usual function of the jacket part of the structure is to support a working deck 14 at an elevation where it will be beyond the normal reach of the surrounding water.

Figure 1:
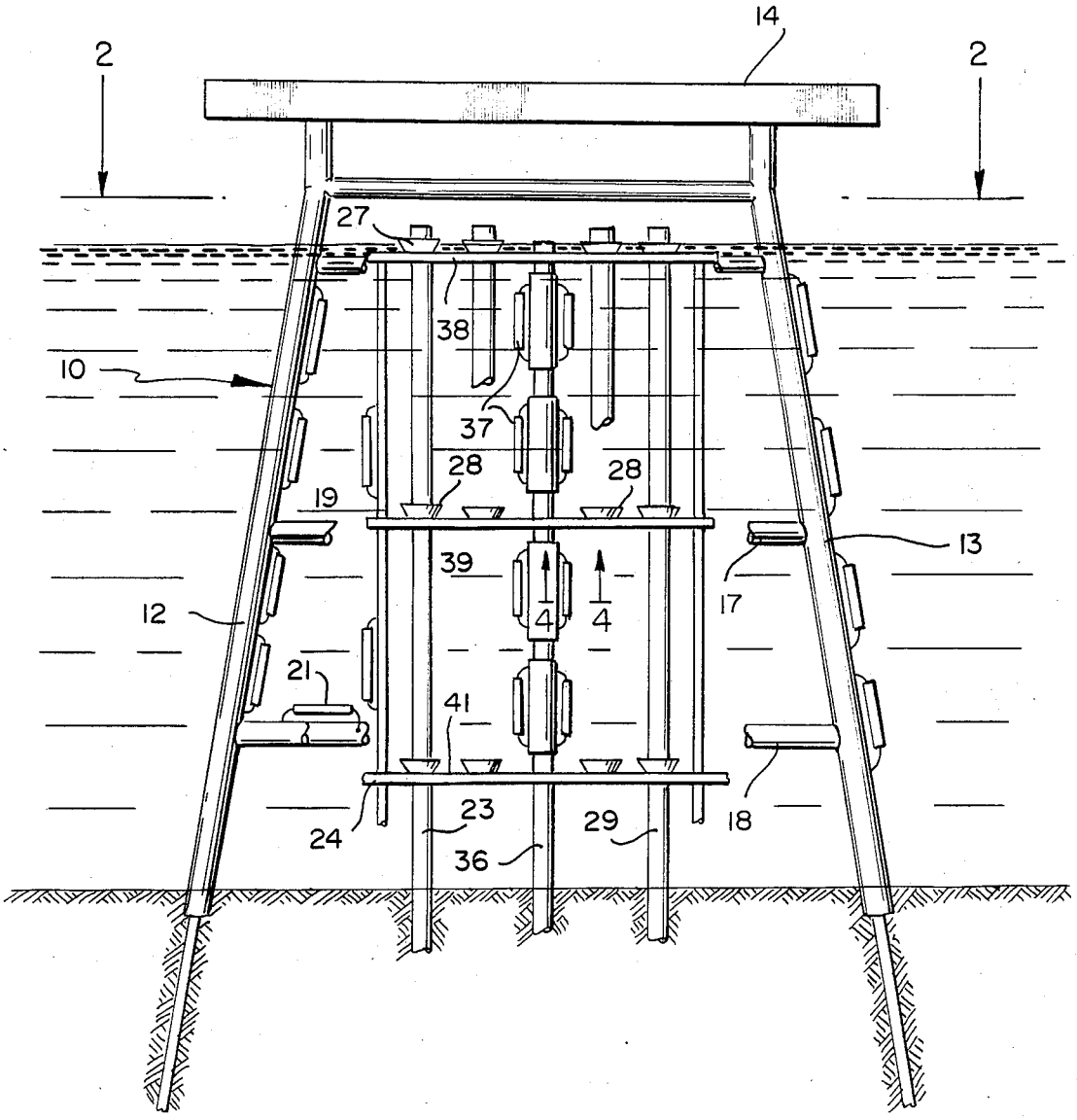
FIG. 1 is an elevation, with parts broken away showing a marine platform of the type contemplated.

Legs 12 and 13 as shown are preferably battered to a limited degree to afford the structure stability. However, each leg is provided with means for accommodating one or more piles 16 which are driven downwardly through the leg or adjacent thereto and embedded into the ocean floor 11. The piles are driven to such a depth that they can best effectuate a firm footing for the jacket in spite of severe weather conditions.

Each jacket leg 12 and 13, is provided with a series of bracing or cross members 17 and 18 which mutually connect the unit into a rigid, open framework.

Following general construction practice, the submerged portion of jacket legs 12 and 13, as well as the cross members 17 and 18, are provided with a primary series of judicially placed sacrificial anodes 19 and 21. The latter are spaced in such manner to minimize their number, and yet to adequately protect adjacent structural members.

Sacrificial anodes of this type are well known to the offshore industry and as herein noted, are generally comprised of a metal such as aluminum, zinc or magnesium. They are supported and positioned to best achieve their protective function. Physically, one embodiment of such an anode comprises a metallic, erodible block which is carried on a bent, steel support rod which is fastened to the protected part.

Internally, the jacket structure is provided with or incorporates a drilling template 22. Said member functions to support and position drill conductor 23 which guides and encloses a downwardly moving drill string for drilling a well into the ocean floor 11.

The primary function of each conductor 23 is to provide a separate closed path for guiding the drill string between working deck 14 and the ocean floor. In this respect, template 22 comprises a series of spaced apart elongated conductors 23 and 29, formed of steel pipe, tubing or the like. Each conductor not only registers a rotating drill string, it concurrently affords a closed path for circulating lubricating mud and removing cuttings.

The various conductors 23 are positioned and spaced in template 22 in a manner that the respective wells drilled therethrough will enter a limited area of ocean floor 11. However, once the wells have penetrated the floor, they can be diverted outwardly and assume a preferred direction away from the platform to reach a productive formation.

Figure 2:
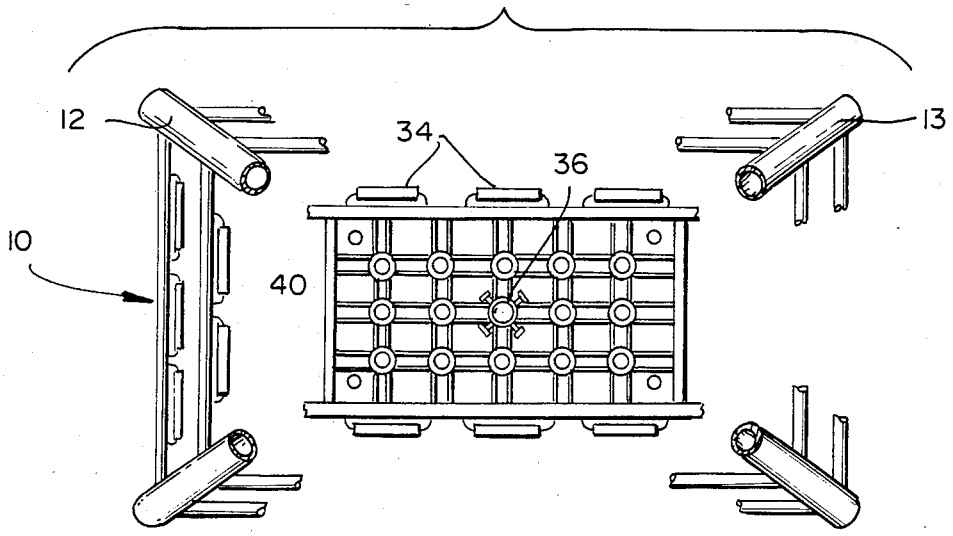
FIG. 2 is a cross-sectional view taken along line 2—2 in FIG. 1.

As shown in FIGS. 1 and 2, to assure the most effective use of drilling template 22 the latter is comprised of a series of vertically spaced grid-like sections 38, 39 and 41 which define a series of slots 40. Said segments are spaced one from the other and fixedly positioned by upstanding corner posts 26 and 30.

Following normal well drilling practice, template 22 isn't usually provided with conductors, until the template is set at its underwater position and is determined that a well is to be drilled. This practice minimizes initial jacket weight, and avoids the premature installation of conductors which might never see use.

In anticipation of a drilling operation, after the jacket 22 has been set at an offshore site, one of the slots in template 22 is provided with elongated steel conductor 23. The conductor is lowered through the various levels of template 22 and is guided by spaced apart and vertically aligned conical conductor guides 27 and 28. The latter depend from the multiple, grid-like segments 38, 39 and 41, respectively.

With conductor 23 firmly positioned in the template, the drilling operation can commence by registering a drill string therethrough. The rotating string is then lowered to form a vertical wellbore into the formation. Thereafter the bore can be diverted into a desired direction to reach a particular formation.

As a well is completed and additional wells are to be formed, additional conductors such as 29 will be lowered through drilling template 22. By relocating the drill derrick and rotary table over conductor 29, or any subsequent conductor, the next well can be commenced.

Figure 3:
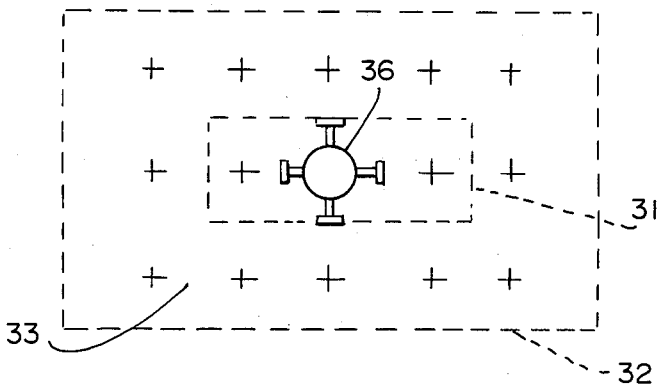
FIG. 3 is a graphical representation of a conductor plan or array.

As shown in FIG. 2, the respective slots 40 in template 22 grid-like segment 38, are spaced substantially equally apart to best accommodate an anticipated multi-well drilling operation. As seen in FIG. 3, when all template slots are occupied, the multiple conductors define an array 32 comprised of internal conductors 31, which are surrounded by a group of peripheral or external conductors 33.

It can be appreciated that over a period of time all internal conductors 31 will not be subject to an equal degree of cathodic protection afforded by the primary sacrificial anodes which are dispersed about the jacket and template. Supplemental means is therefore provided to assure that said internal conductors 31 are brought within a protective zone or throw of the sacrificial anodes.

Drilling template 22 is thus provided with one or more supplemental columns 36, which can also function as conductors, and which are disposed inwardly of external conductors 33. Supplemental column 36 is so positioned to extend the reach of corrosion protection to the internally grouped conductors 31.

As shown in FIG. 3, template 22 is provided with one or more of said supplemental columns conductors 36 which are generally surrounded by, or encompassed by the external conductors 33 in array 32. Said column 36 in achieving its function, is provided with a plurality of vertically spaced secondary sacrificial anodes 37 disposed along its outer surface.

To facilitate replacement of anodes 37 at such time as they have been eroded away, column 36 is preferably removably positioned within template 22. The latter is therefore provided with a series of vertically aligned openings through which the anode carrying column 36 can be passed particularly for removal thereof for anode replacement.

Column 36 lower end can be registered in a conical guide 42 in grid section 41 to minimize the lateral movement of the column. The upper grid sections, however, are provided with an enlarged passage through which the column registers to accommodate the outwardly depending anodes 37, thereby to avoid damage to the latter.

Column 36 upper end is fastened to upper grid section 38 and can be adjusted both rotatably and longitudinally relative to the jacket and to template 22. Such movement, by optimally positioning andoes 37, will achieve optimum coverage of the respective conductors as more of said members are added to the template array.

Figure 4:
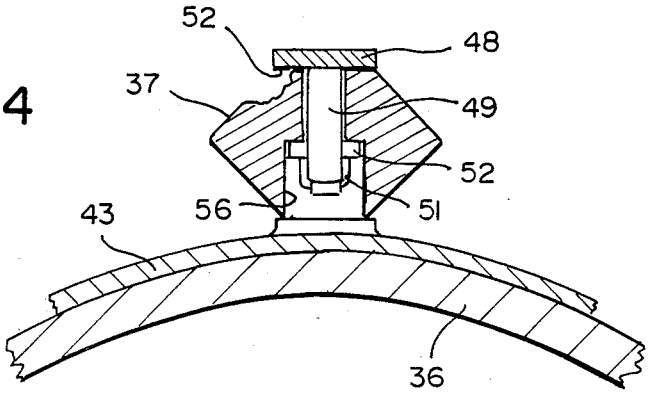
FIG. 4 is a cross-sectional view taken along line 4—4 of FIG. 1.
Figure 5:
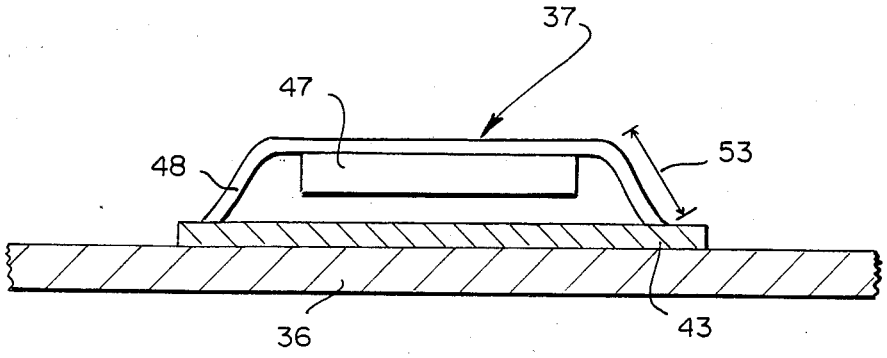
FIG. 5 is a cross-sectional view taken along line 5—5 of FIG. 4.
Figure 6:
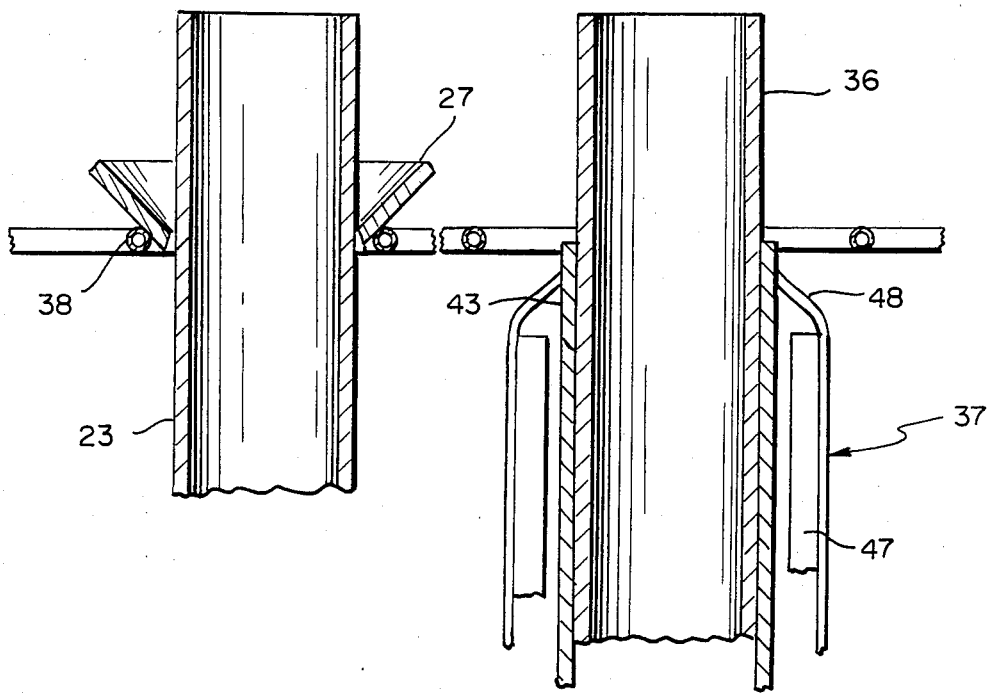
FIG. 6 is a cross-sectional view on an enlarged scale showing the novel conductor to a standard conductor.

As seen in FIGS. 3 and 4, in one embodiment, anodes 37 are arranged about the periphery of column 36 to achieve best throw coverage. The anodes 37 therefore in one embodiment can be carried on a ring 43 which removably fits about column 36. Ring 43 is preferably split into two sections each of which carries some of electrodes 37 and which ring sections detachably cooperate with each other to define the removable anode carrier.

The number of columns 36 which are initially installed in template 22 will depend on the number of conductor slots which will be ultimately used in a structure's drilling program. However, as noted above, the anode carrying conductor can be inserted into template 22 only at such time as needed to maintain the desired level or degree of cathodic protection best suited to the conductor pattern, or partial pattern.

Referring to FIG. 4, the type of sacrificial anode 37 herein disclosed for use on column 36 is usually comprised of an elongated bar 47 formed of the sacrificial metal. Said bar can comprise any number of shapes and configurations. It is however mounted to a support bracket 48. The respective ends of the latter are adapted to be welded to or otherwise fastened to a conductor surface or to a mounting ring 43 segment.

Although as shown in FIG. 3, four anodes depend radially from column 36, the number thereof, and their radial spacing about the column, can be varied.

To facilitate insertion or removal of column 36, the outwardly depending anodes 37 are arranged such that the steel support bracket 48 will protect the anode bar. Bracket 48 is therefore fixed to the upper surface of the anode bar 47 by a series ofstuds 49 which extend into anode cavity 56. A fastening nut 51 fits within cavity 56 and bears against a washer 52 to removably position the members into a composite assembly.

Each remote end of bracket 48 is bent to form a sloping guide surface 53. Thus, as conductor 36 is lowered or raised through template 22, the relatively heavy mounting bracket 48 will slidably contact template parts thereby avoiding damage to either the anode bar 47 or to template members.

Although modifications and variations of the invention may be made without departing from the spirit and scope thereof, only such limitations should be imposed as are indicated in the appended claims.

We claim:

1. In a marine structure having a deck and a rotatable drill string for drilling wellbores into the floor of a body of water, a jacket comprised of corrodible metallic members including support legs which are mutually interconnected with cross braces, and which jacket rests on the said floor and supports said deck above the water's surface, a drilling template incorporated into said jacket to accommodate drilling conductors for guiding said rotatable drill string which is lowered from the deck to form a vertical wellbore, said drilling template including vertically aligned elongated conductor guides arranged in a horizontal pattern to define a drill conductor array comprised of external conductors, which encompass at least one internal conductor, a cathodic protection system protecting said corrodible metallic members of said marine stucture comprising a first sacrificial anode system disposed on discrete submerged jacket members to afford corrosion protection to said jacket members as well as to submerged sections of the drill conductor array, and other sacrificial anodes removably carried on said at least one internal conductor to supplement the cathodic protection afforded by said first sacrificial anodes.

2. In the apparatus as defined in claim 1 wherein said drill conductor array in said template includes; a plurality of internal conductors which are encompassed by external conductors, and said other sacrificial anodes are removably carried on said at least one internal conductor.

3. In the apparatus as defined in claim 1 wherein said sacrificial anodes are spaced vertically along said at least one conductor and rotatably adjusted thereon.

4. In a marine structure for drilling wellbores into the floor of a body of water, a jacket comprised of support legs which are mutually interconnected with cross braces and which support a deck above the water's surface, a drilling template disposed within said jacket to accommodate drilling conductors for guiding a rotating drill string which is lowered from the deck during the formation of a vertical wellbore, said drilling template including; horizontally spaced and vertically aligned conductor guides which are arranged in a pattern to define a conductor array comprised of external conductors which encompass at least one internal conductor, disposed internally of the conductor array, having an inner diameter sufficient to guidably receive a rotating drill string, and to externally hold at least one anode carrying ring which supports a plurality of other sacrificial anodes thereon, other sacrificial anodes depending outwardly from said ring.

5. In a marine structure as defined in claim 4 wherein said other secondary sacrificial anodes include; an elongated body formed of a metal capable of eroding away when in contact with an electrolyte, and having an outer support member which extends parallel to the said column thereby defining an outer protective surface to the anode.

6. In a marine structure as defined in claim 5 wherein said sacrificial anode support member includes; a guard bar positioned outwardly of the anode body and engaged therewith along said outer surface.

7. In a marine structure as defined in claim 4 wherein said at least one anode support ring is slidably received on said column and includes a plurality of anodes depending outwardly therefrom.

8. In an apparatus as defined in claim 7 wherein said anode carrying ring is longitudinally split whereby to permit assembly and disassembly thereof onto and from said column.

9. In an apparatus as defined in claim 6 wherein said outwardly depending anodes include an offset elongated support bar having the remote ends thereof fixed to said ring thereby defining an intermediate space therebetween, said anode being positioned in said interspace and depending from said support bar.

10. In the marine structure as defined in claim 9 wherein said anode supporting bar 48 includes sloped end sections, and a center section which connects the respective end sections to define said intermediate space.

* * * * *